United States Patent [19]

Esker et al.

[11] 4,014,482

[45] Mar. 29, 1977

[54] MISSILE DIRECTOR

[75] Inventors: Andrew T. Esker, Florissant; John L. Manche, Bridgeton, both of Mo.; Robert M. Siler, Anaheim, Calif.

[73] Assignee: McDonnell Douglas Corporation, St. Louis, Mo.

[22] Filed: Apr. 18, 1975

[21] Appl. No.: 569,445

[52] U.S. Cl. ..... 244/3.13; 250/203 R; 356/4

[51] Int. Cl.[2] ..... F41G 1/46; F42B 15/10; G02B 27/00

[58] Field of Search ..... 244/3.13, 3.16; 250/203; 356/4; 102/70.2 P

[56] References Cited

UNITED STATES PATENTS

| | | | |
|---|---|---|---|
| 3,676,003 | 7/1972 | Naiman et al. | 356/4 |
| 3,690,594 | 9/1972 | Menke | 244/3.13 |
| 3,807,658 | 4/1974 | Miller et al. | 244/3.13 |

*Primary Examiner*—Samuel W. Engle
*Assistant Examiner*—Thomas H. Webb
*Attorney, Agent, or Firm*—Lionel L. Lucchesi

[57] ABSTRACT

A line of sight guidance system is provided in which the radiated output of a pulsed laser is spatially modulated to produce a beam radiated from an optical projector containing all informational requirements to enable a missile launched into the beam to determine its position with respect to beam center. The guidance system includes a single beam projector at a launch site, and a single beam receiver and signal decoder carried by the missile. The beam projector includes a laser diode source, laser pulse driver circuits, beam encoder, optic means for projecting the encoded beam, and electronic circuits for controlling the optic means operation. The beam encoder includes a reticle having a plurality of spokes formed in it, an opto-interrupter for sensing reticle center rotation rate, and drive motor control electronics. The reticle has a center mounted for rotation about the generated beam so that at least a portion of the reticle intersects the beam in all positions of the reticle. The laser diode source is pulsed at two different rates, which rates are coordinated with the angular position of the reticle. The laser beam is encoded by rotating the center of the reticle about an axis of the optical system in conjunction with the variation of the pulse repetition rate of the laser source, to produce a spatial modulation of the radiated beam. The projected beam, consequently, is a binary coded coordinate grid and reference data pattern which contains in itself all of the magnitude and phase components necessary for a properly equipped missile to define its location with respect to the beam coordinate center, once the missile is launched into the beam pattern. The receiver and decoder are utilized to derive signals for positioning the missile along the beam center by separating the incoming pulse train into an information channel and a phase reference channel. The optic means for projecting the beam includes a zoom optic system designed to permit use of a low power beam, the beam radiation being spread over a large angle at missile launch. The beam angle is decreased as the missile flies towards a target, thus maintaining approximately constant beam power density at the missile throughout flight, while minimizing the beam power density at the target.

26 Claims, 13 Drawing Figures

$\Delta f$ - DISPLACEMENT FROM BEAM CENTER
$\beta$ - DIRECTION OF DISPLACEMENT

MISSILE DIRECTOR

BACKGROUND OF THE INVENTION

This invention relates to a line of sight guidance system, and in particular, to a guidance system for a beam rider missile. While the invention is discussed in particular detail with respect to its missile control application, those skilled in the art will recognize the wider applicability of the inventive concepts disclosed hereinafter.

It further relates to a method for providing an encoded beam pattern by rotating the center of a reticle so that the reticle intersects the beam and coordinating the pulse repitition rate of the beam source with the reticle center position.

The prior art reveals a number of devices for aiming and guiding projectiles of various designs toward a target. One particular projectile design with which the invention disclosed hereinafter has particular application is described in the U.S. Pat. No. to Tucker, No. 3,868,883, issued Mar. 4, 1975. The missile disclosed in the Tucker patent includes means for positioning a missile along a line of sight and includes thruster elements, the firing rate and firing direction of which are controlled to position the missile. The electrical signals for firing rate and firing direction are generated at the launch site and transmitted to the missile along a physical connection between the launch site and the missile. While the apparatus disclosed in the Tucker patent works well for its intended purpose, there are instances where the physical connection between a launch site and the missile are undesirable. For example, missile travel over bodies of water cannot be conducted reliably because the connections between the site and the missile often will dip into the water, sometimes causing malfunction of the physical connections. Our invention is intended to be compatible with the projectile disclosed in the Tucker patent, although its application is not limited to that projectile type. Constructional features of the missile, while important in overall weapons system performance, are not described in detail. Details of the missile construction may be obtained from the above-referenced Tucker patent.

In general, our invention relates to a projectile or missile guidance system in which a frequency modulated encoded laser beam is projected to provide control of a beam rider missile in two degrees of motion. In particular, the system includes a laser beam pattern projector including a rotating reticle with a rotating center for chopping the laser beam. The laser beam source is pulsed at two different rates in synchronism with the angular position of the reticle center, thereby providing a binary coded coordinate grid and a reference data pattern which contains in itself all the magnitude and phase components necessary to define the location of the projectile in the grid pattern. The reticle center rotation and the rotation of the reticle about its center are phased so that noise components in the beam produced by mechanical and optical fabrication tolerances appear in the missile borne decoder at frequencies above the required missile control frequencies, and therefore may be removed easily, for example, by use of proper filters, during processing of the control signals. The projected power density of the beam at the range of the missile is held constant during most of the missile flight by the programming of a zoom lens to track the missile. Consequently, the sensitivity of the missile receiver to displacement in the grid also remains constant. The decoding devices carried by the missile include a single receiver and a decoder which separates the incoming beam signal into two channels, a first channel reference for establishing a phase reference signal, and a second, information channel containing the beam spatial frequencies for determining displacement and unreferenced direction of the missile from beam center. The phase reference signal is separated into vertical and horizontal (quadrature) signals that are multiplied with the information signal to produce error signals. The error signals are used to produce the necessary projectile control commands for positioning the projectile along the beam center.

The prior art reveals a number of devices for providing FM modulation of a projected beam. For example, the U.S. Pat. No. to Menke, No. 3,690,594, issued Sept. 12, 1972, discloses a frequency modulated beam generated by a rotating reticle having a nutating center. Our invention is distinguished from the Menke patent, and similar art in the field of our invention, in that phase reference lateral distance and direction data are transmitted in a single beam from a single projector. Because the beam contains all necessary information for position determination, only a single receiver is required for beam reception at the projectile. Consequently, the overall system design is simplified while the data link between the launch site and the missile is improved.

Our invention finds particular application in guided missile systems which require highly secure, accurate, low-cost guidance means for use against tactical targets. A typical anti-tank weapon application employing the guidance system of this invention can be made light enough to be carried and operated by one man. The missile system can be operated under either day or night lighting conditions. Of primary importance is the high degree of security against battlefield countermeasures which is achieved because the missile carries a single information input receiver/detector which accepts beam radiation energy only from the area behind the missile, and beam operation in a portion of the infrared frequency spectrum which is undetectable to the unaided eye. Detection of the beam by sophisticated detection devices at the target is made difficult by use of a low power beam which has its beam radiation energy spread over a large angle at the time of missile launch. The large beam angle at launch ensures missile capture by the beam, and initiation of missile guidance shortly after launch. The beam angle is decreased as the missile flies to the target, thus maintaining essentially constant beam power density at the missile throughout flight while minimizing the power density on the target. In addition, the variable beam angle simplifies missile electronic circuit design and permits the maintenance of guidance accuracy nearly independent of target range. The beam angle variation is provided by an optical system which incorporates a variable power field of view, commonly referred to as a zoom lens, and means for controlling the zoom lens drive in accordance with missile position.

One of the objects of this invention is to provide means for guiding a missile or other device along a line of sight path.

Another object of this invention is to provide improved means for controlling the flight of a projectile.

Another object of this invention is to provide a guidance system having improved accuracy for guiding a projectile towards a target.

Yet another object of this invention is to provide a line of sight guidance system which is relatively inexpensive, light weight, portable, and requires little or no special skill or training in its operation.

Yet another object of this invention is to provide a guidance system having a continuously generated beam projected by a single projector, which beam contains all data elements necessary for the determination of distance and direction from a point in the beam to the center line axis of the beam.

Another object of this invention is to provide a guidance system for a missile which provides approximately constant beam power density to the missile throughout the flight of the missile.

Still another object of this invention is to provide a missile guidance system that requires only a single receiver for reception of beam information at the missile.

Another object of this invention is to provide a guidance system utilizing a laser diode that is pulsed electronically at different rates during beam projection.

Another object of this invention is to provide a guidance system for a missile which provides approximately proportional changes in the spatial frequencies to the missile's receiver, as compared to the change in the lateral position of the missile throughout most of the missile's flight.

Other objects of this invention will be apparent to those skilled in the art in light of the following description and accompanying drawings.

SUMMARY OF THE INVENTION

In accordance with this invention, generally stated, a guidance system is provided which includes a beam projector at the launch site, and a beam receiver and signal decoder carried by an object to be guided, preferably a missile or similar projectile. The beam projector is adapted to generate a laser beam along a central, optical system axis and includes a rotating reticle having a rotating center for chopping the laser beam. The laser source is pulsed at two different rates, particular rates being coordinated with reticle center position. The varying pulse repetition rate of the beam in combination with the frequency modulation provided by the reticle movement enables a single projector to transmit a continuous beam pattern containing all information required to enable the missile to position itself properly along the beam central axis. The optical system includes means for maintaining the power density of the beam at the missile constant for substantially the entire distance of missile travel. A beam receiver and signal decoder carried by the missile separates the incoming signal from the projector into command signals for positioning the missile. A method for providing an encoded beam pattern by rotating the center of a reticle so that the reticle intersects the beam and coordinating the pulse repetition rate of the beam source with the reticle position.

DESCRIPTION OF THE PREFERRED EMBODIMENT

Figure 1:
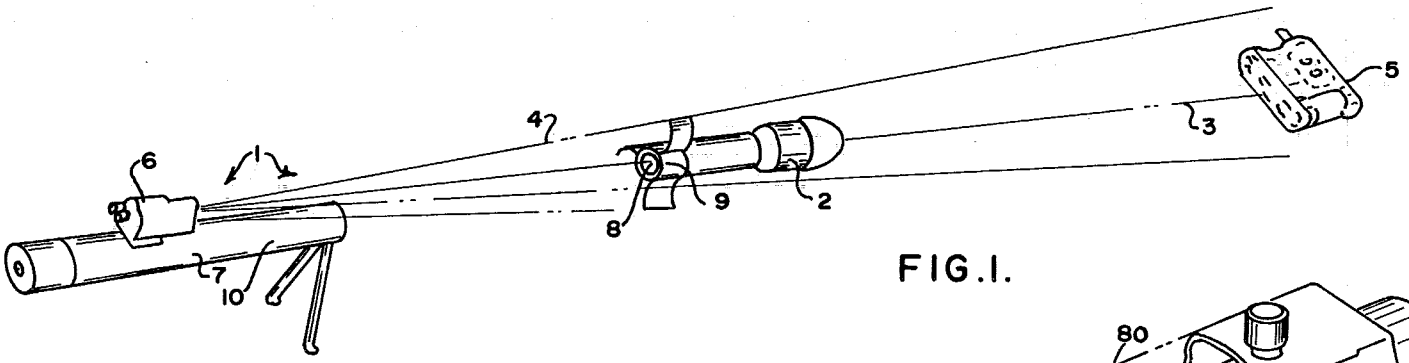
FIG. 1 is a view in perspective showing the relative in-flight positions of a launch site and beam projector or missile director, a missile, and a target.

Referring now to FIG. 1, reference numeral 1 indicates a guidance system for directing a projectile, for example, a missile 2, along a center line axis 3 of a beam 4 which illuminates both the missile 2 and a target 5. The beam 4 is generated by a missile director 6 associated with a launch device 7.

The launch device 7 and missile 2 may comprise any of a variety of suitable projectile and launcher vehicles. As indicated above the missile and launcher described in the Tucker, U.S. Pat. No. 3,868,883, is particularly well adapted for use with our invention. The particular missile disclosed in the Tucker patent carries a bobbin having a thin, multi-strand wire wound on it, and a flare. The wire is played out as the missile travels along its flight path toward the target. In our invention, the wire, bobbin, and flare are eliminated, and a receiver 8 and a decoder 9, later described in detail, occupy that portion of the missile formerly occupied by the wire, bobbin, and flare configuration.

Figure 2:
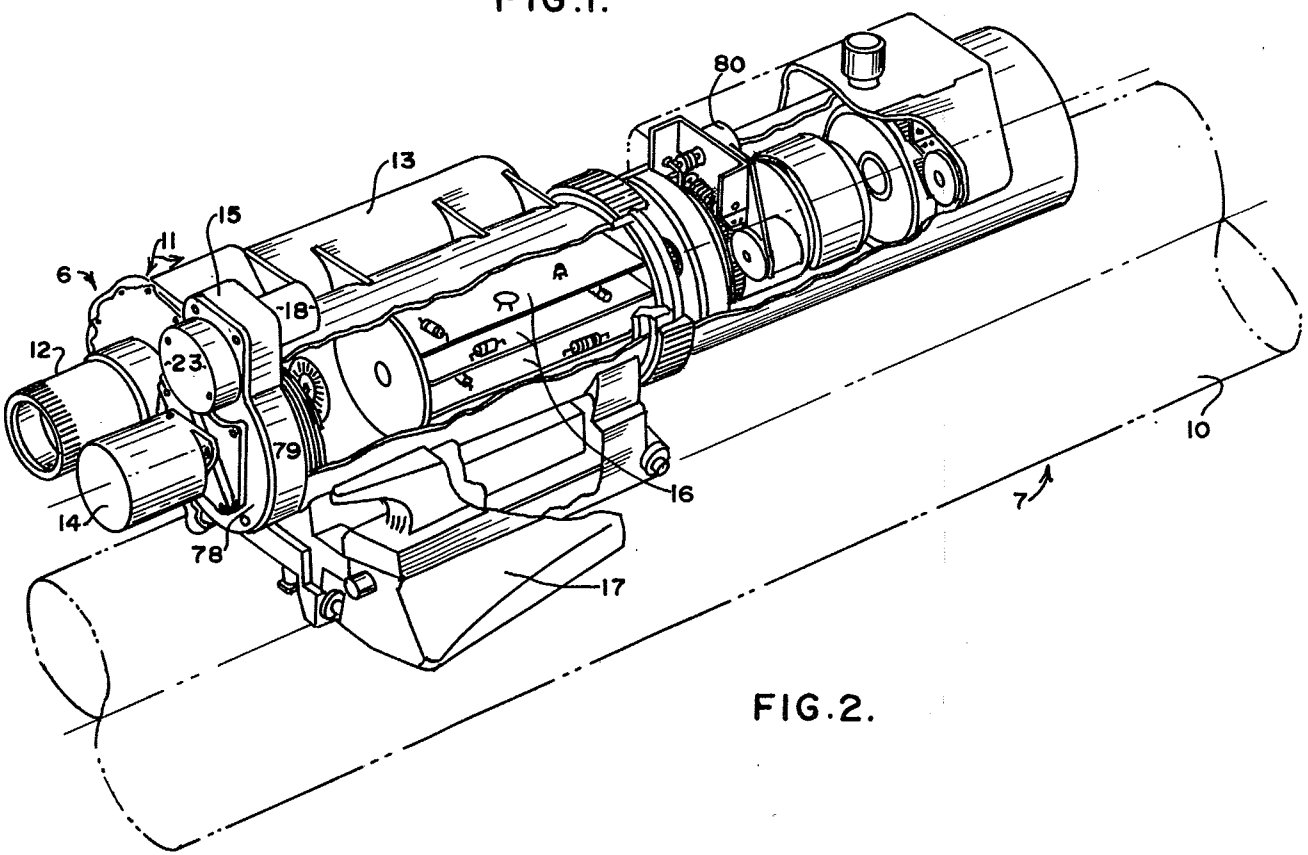
FIG. 2 is a view in perspective of one illustrative embodiment of missile director of this invention.

The launch device 7 includes a tube 10 and preferably is of a recoilless weapon type. The director 6 includes a housing 11 (FIG. 2) having a face guard (not shown), an eye piece 12, and a sighting scope 13 associated with it. The eye piece 12, sighting scope 13 combination is utilized by the operator of the launch device 7 to aim the device and track the target 5 during operation of the system 1. Also contained within the housing 11 are a laser diode source of radiation 14 and its associated driver and control circuits, a beam encoder means 15 and its associated control circuits, and a zoom lens optical system 80 and its associated drive circuits. The housing 11 is intended to be removably mounted to the launch device 7 by any convenient method. Launch device 7 conventionally is disposable, although in certain applications, the device 7 may be utilized repeatedly. It may be observed, in FIG. 2, that the laser source 14 is aligned with the encoder 15 and the optical system 80. The beam projected by the director 6 physically passes through an electronic package area 16, which is physically arranged so that no interference with the beam occurs. Other embodiments of our invention may reposition the package area 16.

Figure 3:
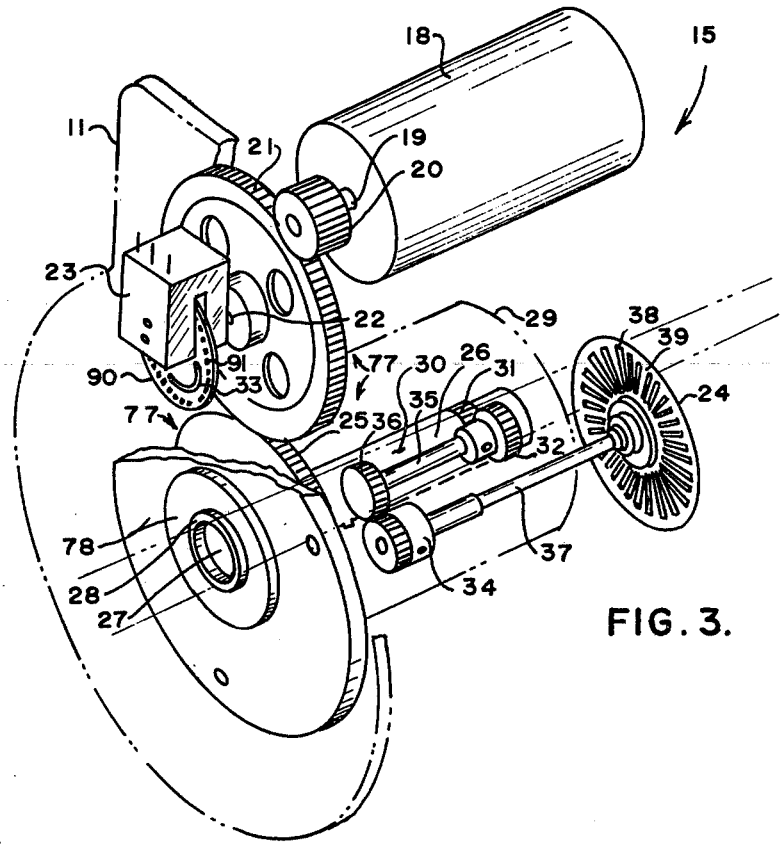
FIG. 3 is a view in perspective of an encoder assembly utilized in conjunction with the missile director of FIG. 2.

The beam encoding means 15 is shown with more particular detail in FIG. 3. As there illustrated, a DC motor 18 has an output shaft 19 attached to a first gear 20 of a gear train 77. The gear 20 is coupled to an encoder gear 21 by a conventional gear tooth arrangement, the gear teeth being diagrammatically shown in FIG. 3. The encoder gear 21 is mounted for rotation along a shaft 22. The shaft 22 also is mechanically coupled to an opto-interrupter means 23. The function of the opto-interrupter means 23 is described in greater detail hereinafter. It is sufficient here to note that the opto-interrupter means 23 generates a signal corresponding to the angular position of the center of a reticle 24.

The encoder gear 21 drives a third rotor gear 25. Rotor gear 25 has a central opening in it, which is sized to receive a spindle 26. Spindle 26 is attached to a wall 78 of the housing 11 for the encoder means 15. The gear 25 is supported for rotation about the spindle 26 by suitable bearing means, not shown.

The spindle 26 has a bore 27 through it. The bore 27 is a tapered opening defined by a wall having an anti-reflective coating disposed on it. The bore 27 is sized to permit the laser beam radiation to pass through the spindle 26. Suitable collection optics, indicated generally by the numeral 28, may be positioned along one end of the bore 27 opening to collimate the beam for passage through the spindle. The spindle 26 has an outer wall 30 having a gear means 31 formed in it. The gear means 31 is intended to intermesh with an intermediate gear 32.

A rotor 29 is mounted for rotation with the rotor gear 25. The rotor 29 is shown in phantom lines in FIG. 3 for drawing simplicity. In general, the rotor 29 encloses the spindle 26 and the rotor may comprise a variety of structures. The rotor 29 is mounted for rotation with respect to the spindle 26 along a pair of precision ball bearing mountings, not shown. The rotor 29 has an intermediate gear shaft 35 attached to it. The gear 32 is mounted on the shaft 35. Consequently, the gear 32 rotates with the rotor 29, around the stationary gear means 31. The gear 32 drives a reticle gear 34 through the gear shaft 35 and an intermeshing gear 36.

The reticle gear 34 drives a shaft 37 having the reticle 24 mounted to one end of it. The rotating motion of the reticle center is produced by the gear train 77 in that the center of reticle 24 rotates about an axis offset from the center line axis of the bore 27.

The rotor gear 25, in the embodiment illustrated, contains 84 teeth. The reticle gear 34 contains 33 teeth, and the gear 36, which drives the reticle gear 34, contains 24 teeth. The gear 32 on the end of the shaft 35 opposite the gear 36, contains 36 teeth. The gear 32 rides around the 33 teeth of the gear means 31 formed on the end of the spindle 26. This gearing combination causes each spoke of the reticle 24 to pass through the optical path two times for each three revolutions of the rotor 29. It thus may be observed that a reticle 24 with a rotational rate of 20 revolutions per second is obtained from a rotor 29 rotational speed of 30 revolutions per second. The rotor 29 is driven by the motor 18 through 21 tooth to 84 tooth gearing. Consequently, the motor 18 operates at 5,200 r.p.m.

Although precision machining techniques and precision instrument gearing are used throughout the encoder 15, all eccentricities, gear composite errors, misposition and misalignment between the rotor bearing mounting diameters and the spindle bore will produce errors in the spatial modulation of the projected beam. These errors will appear as a frequency modulation of the projected rotating reticle image and will be received by the missile as noise on the position error signal. Means for eliminating these errors are described in greater detail hereinafter. It should be here noted that our system will cause these errors to appear at frequencies outside the frequency band needed for missile guidance and, therefore, are removed easily. Consequently, the guidance system 1 of our invention is inherently more accurate than prior art devices.

The reticle 24 is a flat disc with alternating opaque and transparent equal size spokes 38 and 39, respectively. As indicated above, the center of the reticle 24 is mounted so that it is offset from the axis of the optical system. The beam generated by the director 6 will illuminate only a small circular section of the reticle 24 at any particular instant in the operation of the guidance system 1. The remainder of the optical system, more particularly described hereinafter, is used to radiate the laser source 14 energy so as to project an image of the illuminated portion of the reticle 24 into space along the axis of the optical system. In order to encode useable information on the radiated beam, the reticle 24 is moved so as to interrupt the energy radiation at points within the radiated beam. This procedure is best understood when described in conjunction with FIG. 5.

Figure 5:
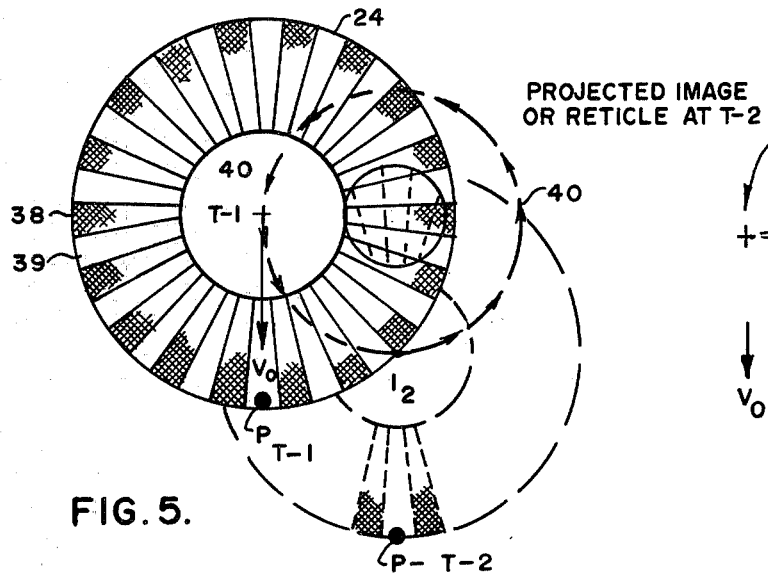
FIG. 5 is a diagrammatic view illustrating reticle center rotation and FM frequency modulating coding of the beam utilized in conjunction with the missile director of FIG. 2.
Figure 6:
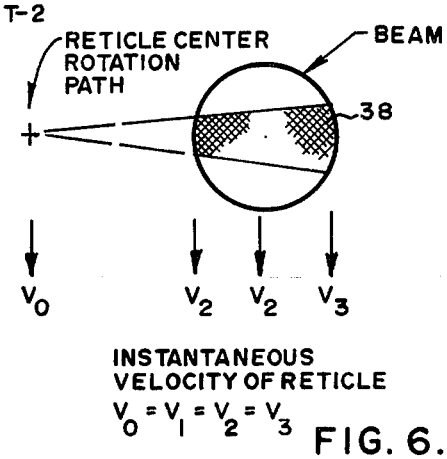
FIG. 6 is a diagrammatic representation of a cross section of the beam projected through the reticle of the missile director of FIG. 2.
Figure 7A:
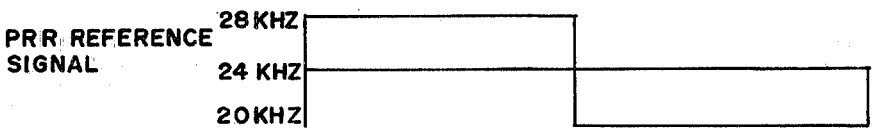
FIG. 7*a* is a graph illustrating the laser output frequency of the missile director of this invention.
Figure 7B:
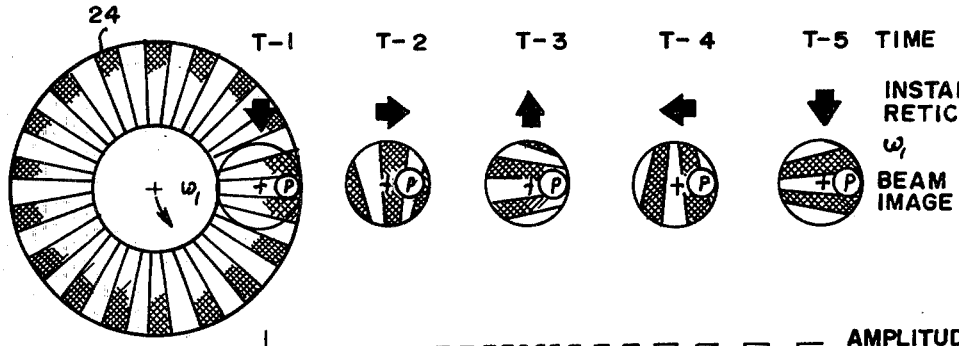
FIG. 7*b* is a diagrammatic representation comparing the instantaneous reticle velocity of a cross section of the beam generated by the missile director of this invention at a point in the beam.
Figure 7C:
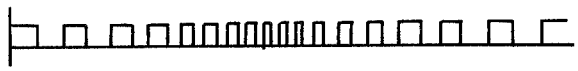
FIG. 7*c* is a graphic representation illustrating the amplitude of a signal received at a point in the beam, individual ones of the pulse plurality shown being, in practice, a group of 20 KHz or 28 KHz, 35 nanosecond pulses; the particular frequency being determined by the position of the reticle center.
Figure 7D:
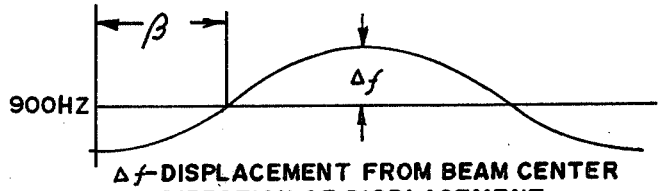
FIG. 7*d* is a graphic representation illustrating the frequency of a signal received at a point P in the beam.

A section of the reticle, which represents the extremity of the projected beam is shown as a solid line circle in FIG. 5, and again in FIG. 6. The reticle 24 is shown in FIG. 5 with the alternating opaque and transparent spokes 38 and 39, respectively, drawn diagrammatically. The reticle 24 center follows the dash-arrow path 40 during one nutational cycle. A point P on the reticle 24 will move from the point shown at the bottom of the full line reticle 24 at a time T-1, to a point shown on the dash reticle 24 at a time T-2. At time T-2, the position of the reticle 24 in the beam will have spokes oriented as shown by the dash-spoke outlines in FIG. 5. As is known in the art, frequency modulation coding of the beam occurs because of the shape of the spoke images and the instantaneous velocity of the spoke image across a detector aperture. In FIG. 6, one spoke of the reticle 24 is shown. If the instantaneous velocity at the center of the reticle 29 is straight down as indicated, for example, in FIG. 5, then the instantaneous velocity of all points on the spoke image also will be straight down and with the same velocity amplitude. Consequently, the receiver 9 of the missile 2 in the beam, looking back at the encoder 14, will receive energy when a transparent spoke 39 of the reticle 24 passes through the beam, and will not receive energy when an opaque spoke 38 of the reticle 24 passes through the beam. For the reticle center position shown when the receiver 9 is displaced horizontally toward the $V_3$ side of the beam center, referenced to FIG. 6, it will see long signal on and long signal off periods, while a receiver 9 displaced toward the $V_2$ side of the beam center will see short signal on and short signal off periods. A frequency discriminator, tuned to the frequency detected at the beam center, will produce an output signal proportional to the displacement of the receiver 9 from the center of the beam. The rate of the reticle center rotation is shown in FIG. 5 to be equal to the reticle rotation rate to permit simplifying the explanation of operation. The frequency discriminator in the missile decoder is, in practice tuned to a frequency slightly above the beam center frequency to take advantage of the frequency non-symmetry to the beam edge which is characteristic of the encoder.

FIGS. *7a* through *7d* illustratively show the beam coding-decoding operation. As later explained, the laser diode for generating the beam is electronically pulsed at 20 KHz during 180° of the reticle center 24 rotation, and at 28 KHz during the other 180° or reticle 24 center rotation. Because of this pulse or rate variation, a phase reference signal may be obtained at the missile and used to reference the information signal phase to determine the direction of missile displacement from the beam center. As the reticle center is rotated through the full rotation cycle, the image projected corresponds to that shown in FIG. *7b*. The receiver 8, decoder 9, carried by the missile 2 in the beam at a point P, will see an error signal whose frequency deviation amplitude, $\Delta f$, will be proportional to the displacement of point P from the center of the beam, while the error signal phase $\beta$, with respect to the reference signal, will be proportional to the direction of the displacement error.

In the specific encoder means 15 utilized in the preferred embodiment of our invention, the reticle 24 is rotated about its center on the shaft 37 so that the rate of the reticle rotation is made to differ from the reticle center rotation rate by 10 Hz. That is to say, both the center of the reticle 24 and the reticle 29 are rotated during operation of the guidance system 1 of this invention. Rotation of the reticle or the reticle center about the axis of the optical system, for the purposes of this specification, is denominated as movement orbital or orbitally. The terms orbital and orbitally are intended to encompass the variety of possible movements of the reticle center in addition to the circular rotation described. The resulting spatial modulation characteristics result in two advantages: (1) noise components, which result from mechanical and optical inaccuracies in the mechanisms comprising the encoder means 15, can be shifted to frequencies outside the missile control range of frequencies processed by the decoder 9 carried by the missile 2, and (2) the slope of the frequency deviation versus missile position in the beam can be increased to improve the resolution of the position error data.

Figure 8:
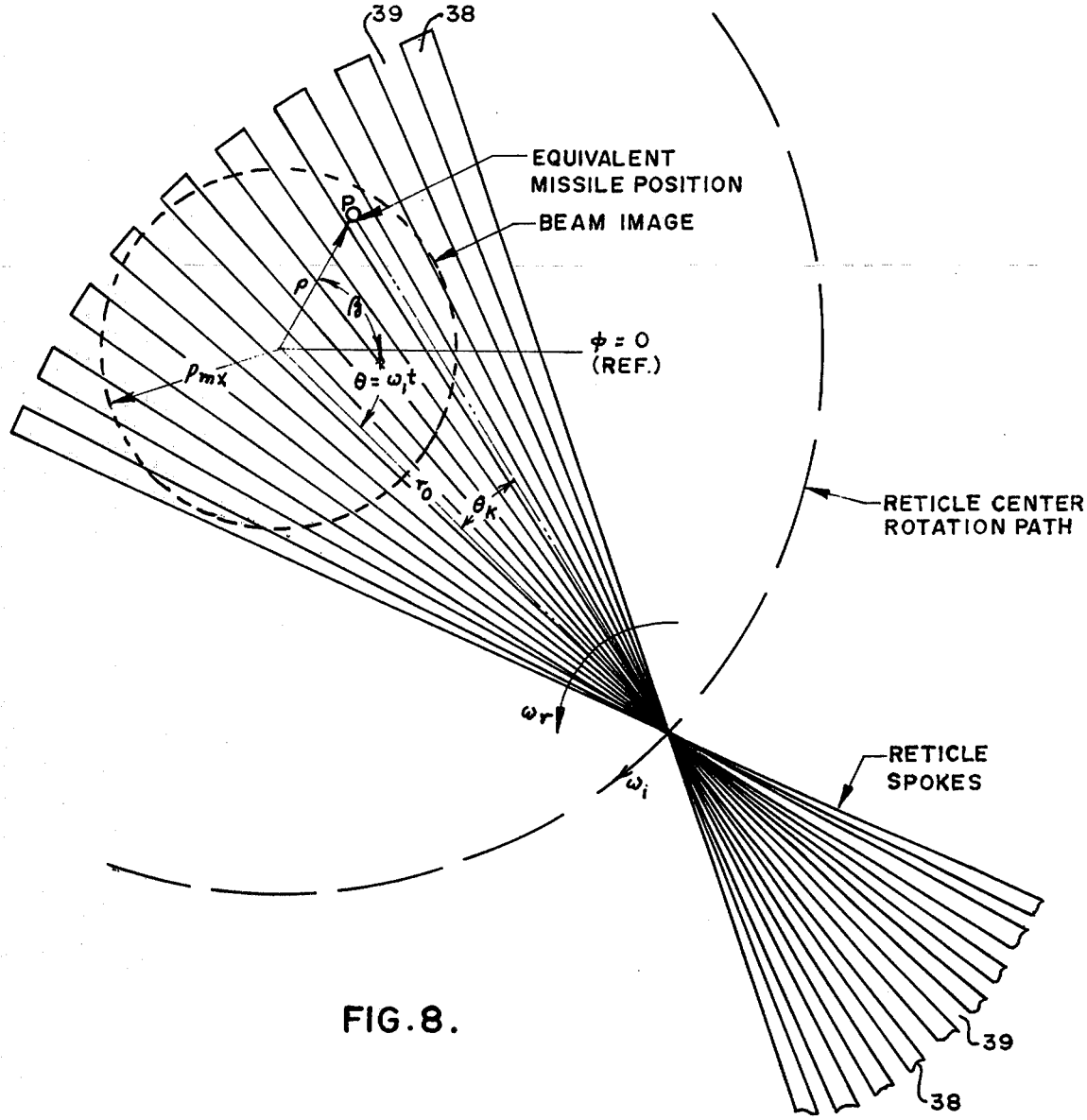
FIG. 8 is a diagrammatic representation useful for explanation purposes in describing the spatial frequency modulation of the beam utilized with the missile director of this invention.

FIG. 8 is a graphic representation which illustrates the encoding function of the missile director 6 and which defines various parameter of the encoder means 15. Only a portion of the spokes forming the reticle 24 are shown for drawing simplicity. The short dash circle with a radius $\rho(\mathrm{RHO})_{mx}$, represents the portion of the reticle 24 that is irradiated by laser output, and also represents the reticle image projected in the beam. The long dash circle with radius $r_o$ is the path followed by the reticle 24 center about the axis of the optical system. For convenience, a representative missile position, point P, is shown a distance $\rho(\mathrm{RHO})$ from the beam center, with $\rho$ at an angle $\beta$ (beta) from the reference axis of the beam, indicated by the symbol $\phi$. The reticle 24 center rotates about the beam center at a rate $\omega_i$, and the reticle spokes rotate about the reticle center at a rate $\omega_r$. The instantaneous angular position of the reticle center is given by the equation $\theta = \omega_i t$. The modulation seen by the missile at point P is related to the passage of the reticle spokes through the beam, which may be observed to be the difference between the rate of spoke rotation, $\omega_r$, and the rate of change of the angle $\theta_k$. The frequency is obtained by dividing this difference by the total angle from the leading edge of one reticle spoke to the next spoke, $20_c$, or:

$$f = \frac{1}{2\theta_c}\left(\omega_r - \frac{d\theta_k}{dt}\right).$$

An expression for $\theta_k$ can be derived using the Law of Sins:

$$\frac{\rho}{\sin\theta_k} = \frac{r_o}{\sin[180° - (\theta_k + \beta + \theta)]} = \frac{r_o}{\sin(\theta_k + \beta + \theta)}$$

which can be reduced to:

$$\theta_k = \arctan\left[\frac{\rho\sin(\omega_i t + \beta)}{r_o + \rho\cos(\omega_i t + \beta)}\right]$$

$$\frac{d\theta_k}{dt} = \left[\omega_i \frac{\rho}{r_o} \frac{\frac{\rho}{r_o} - \cos(\omega_i t + \beta)}{1 - 2\left(\frac{\rho}{r_o}\right)\cos(\omega_i t + \beta) + \left(\frac{\rho}{r_o}\right)^2}\right],$$

then:

$$f = \frac{\omega_r}{2\theta_c} - \frac{\omega_i}{2\theta_c}\frac{\rho}{r_o}\frac{\frac{\rho}{r_o} - \cos(\omega_i t + \beta)}{1 - 2\left(\frac{\rho}{r_o}\right)\cos(\omega_i t + \beta) + \left(\frac{\rho}{r_o}\right)^2},$$

which is in the standard FM form:

$$f = f_o + \Delta f,$$

with, $$f_o = \frac{\omega_r}{2\theta_c} = \frac{N_B\,\omega_r}{2\pi},$$

where: $N_B$ is the number of spokes on the reticle, and, $$\Delta f = \frac{\omega_r \left(\frac{\omega_l}{\omega_r}\right) N_B}{2\pi} \left(\frac{\rho}{r_o}\right) \left[ \frac{\frac{\rho}{r_o} - \cos(\omega_l t + \beta)}{1 - 2\left(\frac{\rho}{r_o}\right)\cos(\omega_l t + \beta) + \left(\frac{\rho}{r_o}\right)^2} \right].$$

The modulation process which takes place in the receiver 8, decoder 9, uses standard FM techniques to extract the missile displacement $\rho$, which appears as the frequency modulation deviation of the beam, and the missile displacement angle $\beta$, which appears as the phase of the frequency modulation referenced to the laser pulse repetition rate (PRR) reference signal.

The frequency characteristics of the missile lateral displacement rates establish the frequency response required in the guidance system 1. The particular missile utilized with the system 1 of this embodiment requires a guidance system frequency response no higher than 3 Hz. Good fidelity for the missile position information can be achieved with a reticle image rotation rate of 10 times the maximum missile rates, or 30 Hz. This establishes $\omega_1$ at 188.7 rad/sec. With the 30 Hz reticle rotation rate, the lowest spatial encoded frequency should be no lower than 300 Hz. The highest spatial encoded frequency is limited by the lower laser diode pulse repetition rate. A minimum of seven pulses to the receiver 8 is desired between reticle spoke images. Therefore, the highest spatial frequency should be no greater than one-fourteenth of the lower pulse repetition rate. As indicated above, 28 KHz and 20 KHz were selected to provide the two-level pulse repetition rate for the reticle image reference signal. With 20 KHz as the lower pulse repetition rate, the highest spatial encoded frequency should be no higher than 1430 Hz. This makes the frequency range from 300 to 1430 Hz available for spatial modulation. As will be appreciated by those skilled in the art, background radiation will have frequency components within this range. Because the frequency characteristics of background noise follow an inverse amplitude versus frequency relationship, the upper portion of the 300 to 1430 Hz range is the most desirable operating range.

As indicated above, error reduction for the system 1 of our invention can be achieved by rotating the reticle 24 center at a rate different from the rate of rotation of the reticle 24 about the optical axis of the encoder means 15. If a rotation rate $\omega_l$ of 1.5 to 3.0 times the reticle 24 rotation rate $\omega_r$ is chosen, noise components produced by inaccuracies and imperfections in the encoder means 15 components and by part dynamic unbalanced conditions can be separated from the position error signals by filtering in the decoder 9 carried by the missile 2.

Figure 4:
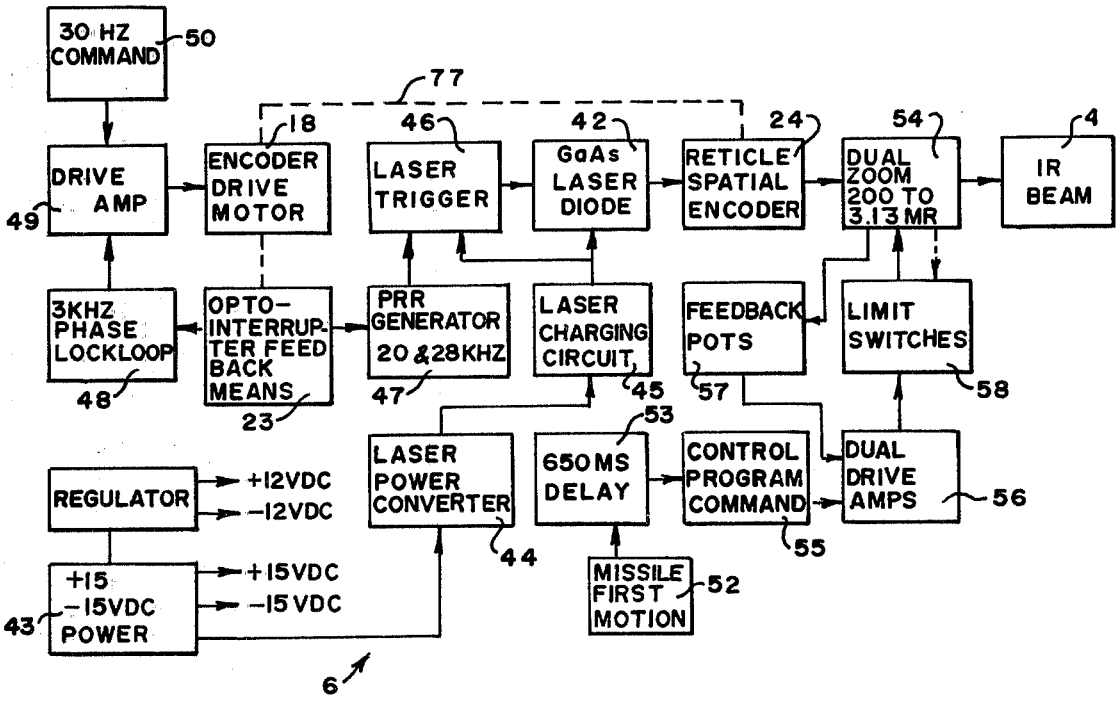
FIG. 4 is a block diagrammatic view illustrating the operation of the missile director shown in FIG. 2.

A functional block diagram of the missile director 6 is shown in FIG. 4. The energy source for the radiated beam 4 is a laser diode 42. The particular device used in the preferred embodiment is an RCA SG2007 laser diode. Other diodes are compatible with the broader aspects of this invention. In general, the diode should be chosen for high power output, symmetry of the radiated output with respect to the diode housing, and uniformity of power distribution in the radiated output pattern.

A power source 43 is operatively connected to a DC to DC converter 44. The converter 44 provides power for a laser charging circuit means 45. The power supply 43 also generates various other voltages required for the operation of the circuits of the missile director 6.

The DC to DC converter 44 provides 100 volts for the laser drive. This voltage is applied through the appropriate charging circuit means 45. The charging circuit means 45 includes a capacitor, not shown, which is discharged through an appropriate silicon controlled rectifier, also not shown, forming a part of a laser trigger means 46. Gate command for the silicon controlled rectifier of the laser trigger means 46 is supplied by a pulse repetition rate generator 47. The pulse repetition rate generator 47 is synchronized with the encoder rotor 29 and reticle center so that it produces either of two pre-established pulse repetition rates during a rotation of the reticle center 24 to provide the reticle image rotation reference signal modulation. The pulse repetition rate is produced by a voltage control oscillator which feeds a pair of transistor switches through a pulse shaping network. The input to the voltage control oscillator is a voltage from a voltage divider whose total resistance is made to change by a transistor switch. The switch is driven by a square wave output of the rotor position opto-interrupter feedback means 23. The pulse generator 47 thereby is coordinated with the drive motor 18 so that the laser diode 42 is pulsed at 20 KHz for one-half cycle of the total reticle 24 rotational cycle and at 28 KHz for the other half cycle.

The opto-interrupter 23 includes two light emitting diodes, not shown, and a disc 90 having 100 equally spaced openings 91 in it, and another opening 33 on a smaller radius, best seen in FIG. 3. In the embodiment illustrated, the opening 33 extends over an arc of 180°. The disc 90 is driven by the drive motor 18 through the gear 21. Two photo diodes are positioned on the opposite side of the disc from the light emitting diodes so as to detect the light emitting diode output as modulated by the disc. The opto-interrupter opening 33 output feeds the generator 47 and the opening 91 output feed a phased lock loop device 48. The phased lock loop device 48 output forms an input to a motor drive means 49. Means for generating a 30 Hz drive command input, generally indicated by the reference numeral 50, also is connected to the motor drive means 49. The drive means 49 powers the drive motor 18, which, as indicated above, is operatively connected to the reticle 24 through the gear train 77, shown in phantom lines in FIG. 4. The components of the gear train 77 were described previously in conjunction with FIG. 3.

The drive command 50 initiates motor 18 activation through the drive means 49. The phased lock loop 48 follows motor 18 speed and provides maximum current to the drive motor 18 from the time power is initially applied, until the drive motor 18 is producing a 30 Hz reference signal. Normal operation of the guidance system 1 is achieved within 0.3 seconds after missile launch.

A missile first motion signal means 52 is operatively connected to the missile 2 when the missile is in its prelaunch position in the tube 10. Upon firing, missile motion is detected and a signal is transmitted by the means 52 to a delay means 53.

The zoom lens optic system 80 includes a two tandem 8:1 zoom lens assembly 54, dual drive means 56, gears for interfacing the drive means 56 to the lenses 54, not shown, feedback potentiometers means 57, a separate objective lens for the rear zoom lens, not shown, and preferably provides provisions for optical alignment of the system. The dual zoom lens configuration is used for several reasons. A production missile director 6 would have an optical system in which the sight and beam are reflexed in a manner to reduce the boresight error. By splitting the zoom requirement between two individual 8:1 zoom lenses, the beam can be sent through both lenses while the director operator need only sight through the second zoom lens. The tandem zoom lenses give adequate guidance system operation at relatively long ranges, approximately 60 times the missile capture range, and operators are able to easily identify and track targets through the single lens.

The zoom lens assembly 54 is programmed from wide beam angle to narrow beam angle to produce a constant beam diameter at the missile 2. An initial beam angle of 200 miliradians is sufficient to effect missile capture. The initial beam angle of 200 miliradians is held constant until the missile 2 reaches the range at which the beam diameter is 7 meters. The delay means 53 prevents initiation of the zoom control program until the missile 2 reaches the proper point in the beam. At that time, delay means 53 initiates a signal which is fed to a control program command means 55. The control program command means 55 provides signal commands to the pair of dual drive amplifying means 56. The output of the means 56 drives the motors, not shown, for operating the pair of lenses of the zoom lens assembly 54. Feedback voltages are obtained from the zoom lens assembly 54 at the feedback means 57. Limit switches, indicated generally by the numeral 58, are used in conjunction with the dual zoom assembly 54 in order to prevent the drive motors from overriding the potentiometers of the feedback means 57 at the end of zoom travel. The beam 4 generated by the laser diode 42, is projected through the reticle 24 and the zoom lens assembly 54 toward the target 5.

As thus described, the guidance system 1 projects a single beam containing all information required for enabling the receiver 8 and detector 9 carried by the missile 2 to determine the missile position with respect to a center line reference axis 3 of the beam 4 and to generate correction signals for directing the missile 2 toward the beam center. By tailoring the zoom control program to the missile range, the guidance system 1 incorporates means for maintaining the beam diameter at the missile, and, consequently, the power density of the beam at the missile, relatively constant along the entire flight of the missile.

Figure 9:
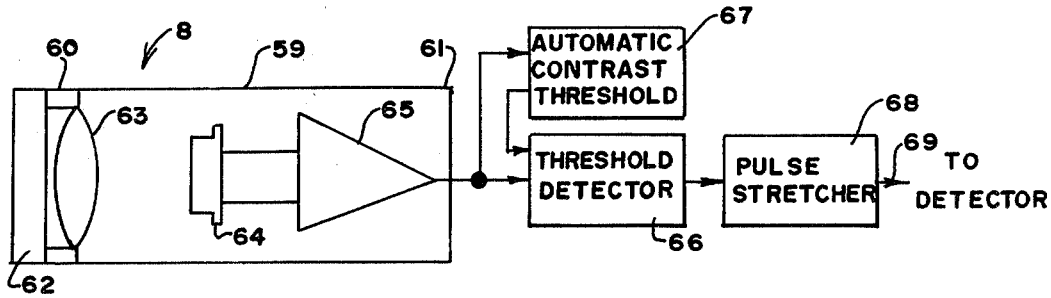
FIG. 9 is a block diagrammatic view of a receiver carried by the missile shown in FIG. 1.

The beam 4 projected by the missile director 6 impinges the missile 2 at the receiver 8. Receiver 8 is shown in block diagram form in FIG. 9. As there illustrated, the receiver 8 includes a housing 59 having a rearward end 60 and a forward end 61. The end 60 has a background filter 62 attached to it which passes the incoming beam radiation and is used to reduce the effects of background radiation and sun reflected energy which may incident the receiver 8. The beam passes through a collecting optic lens 63, which functions to focus the beam toward a photodiode 64. The output of the photodiode 64 is amplified at an amplifier 65. The output of amplifier 65 forms an input to a threshold detector means 66 and an automatic contrast threshold means 67.

The automatic contrast threshold means 67 adjusts the threshold for the received pulse based upon the average of signal-plus-noise when the aperture of the photodiode 64 is irradiated, and signal-plus-noise when an opaque reticle spoke 38 cuts off radiation to the photodiode 64. The circuit reduces the contrast required in the reticle image radiated by the beam 100/1 to 10/1. The optical system of the missile director 6 normally will provide an image contrast ratio in excess of 20/1. The automatic contrast threshold means 67 permits maximum signal utilization by providing low threshold when signal level is low.

A voltage comparator is used to set the signal threshold level in the threshold detector 66. Pulses exceeding the threshold set by the automatic contrast threshold means 67 are used to trigger a one shot pulse stretcher 68. Output of the pulse stretcher 68 is fed to the decoder 9 along an output circuit indicated generally by the numeral 69.

In general, the decoder 9 converts the receiver output into missile displacement error equivalent voltages, processes the displacement error voltages to provide stable missile control commands, compensates the firing rate command for gravitational effects, and generates firing rate and thrust angle commands which are compatible with the control system computer of the missile described in the Tucker patent discussed above.

Figure 10:
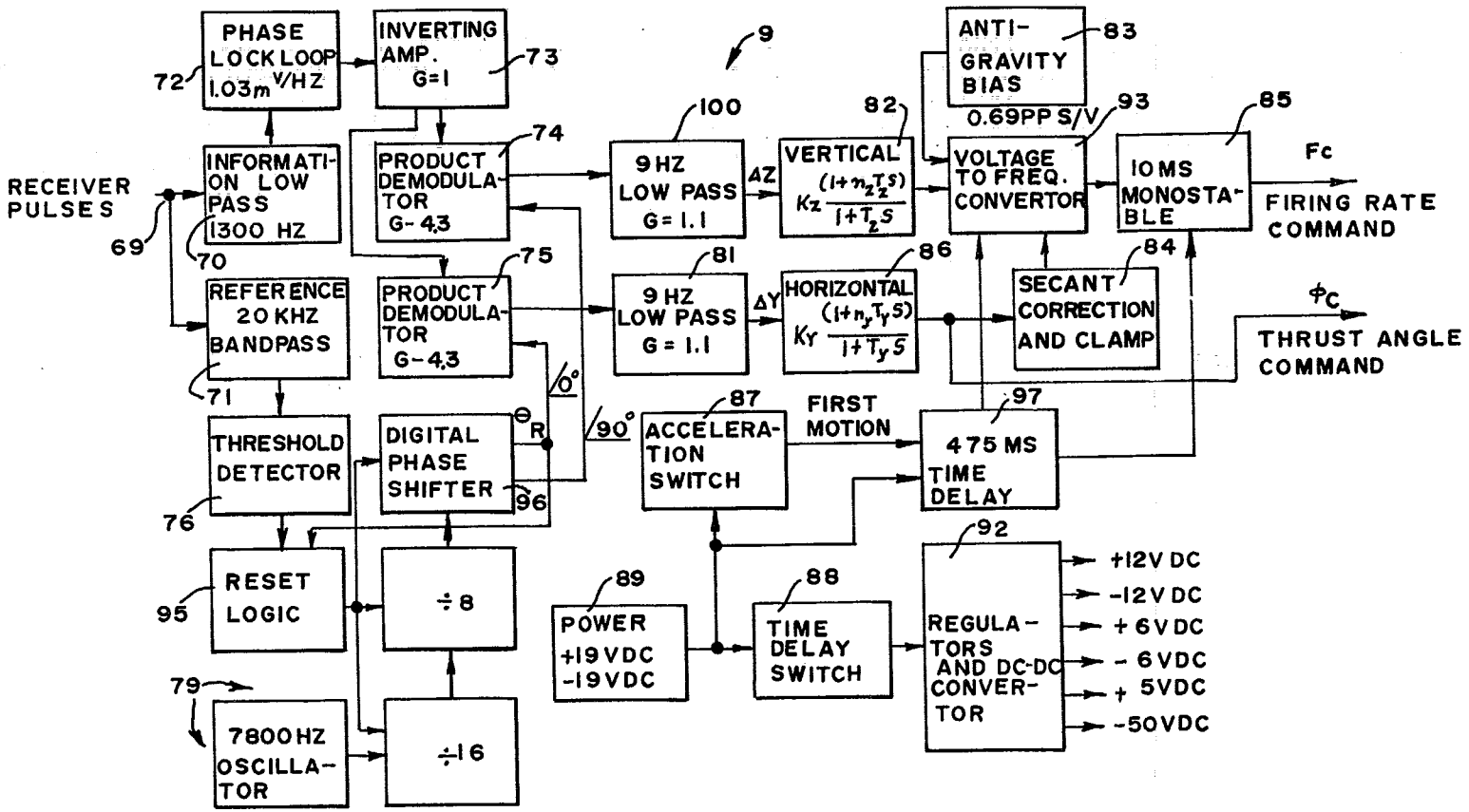
FIG. 10 is a block diagrammatic view of a decoder means carried by the missile of FIG. 1.

A block diagram of the decoder 9 is shown in FIG. 10. As there illustrated, input pulses from the receiver 8 output circuit means 69 from an input to a low pass filter 70 and to a band pass filter 71. The filter 70 removes the PRR and passes the spatial modulation frequencies. An output from the filter 70 forms an input to a phased lock loop means 72. The phased lock loop means 72 tracks the pulses containing the spatial frequencies, and provides an output voltage at the frequency of the encoder rotor with an amplitude proportional to the range of frequency change in the spatial frequencies. This signal provides the information 30 Hz error signal input to an amplifier 73. The output of amplifier 73 forms an input to a first product demodulator 74 and a second product demodulator 75.

As indicated, the output from the receiver 9 also is decoded to provide the reticle 24 center position reference signal. The filter 71 passes the 20 KHz pulse signal, and the output of filter 71 forms an input to a threshold detector 76. The output of the threshold detector 76 provides an output signal at the reticle center rotational rate which is used to synchronize an oscillator divider means 79 through appropriate reset logic means 95. Output from the oscillator divider means 79 is a stable 30 Hz reference signal which forms an input to a digital phase shifter 96. The digital phase shifter 96 produces quadrature 30 Hz signals. The output of the digital phase shifter forms an input to the product demodulators 74 and 75, the 30 Hz signals being used as references in the product demodulators. The outputs of the product demodulators 74 and 75 are filtered by a pair of active 9 Hz corner frequency, double order low pass filters 100 and 81, respectively. Output of the filters 100 and 81 is processed using circuitry similar to that described in the above-mentioned Tucker patent. That is to say, the output from the filter 100 is fed through a rate network 82. Rate network 82 includes a differentiator, and a pair of amplifiers and functions to stabilize the vertical frequency command control loop. The output of rate network 82 forms an input to a voltage to frequency converter 93.

Converter 93 includes an integrator, not shown, that, in addition to signal input from rate network 82, also receives a signal input from an anti-gravity bias signal means 83 and a secant correction and clamp means 84. The secant means 84 functions to correct the anti-gravity bias signal provided by means 83 so that the firing rate command frequency, commanding side thruster firings, for missile position correction is increased as the thrust angle command of the corrective force applied to the missile 2 varies from its zero or vertical thrust firing angle. The increase in side thruster firing rate with an increase in thruster angle off vertical (zero volts), compensates for the reduction in the vertical thrust component from each thruster and holds the vertical antigravity thrust component approximately constant. The particular missile disclosed in the above-referenced Tucker patent uses directable nozzles and short thrust impulses to position the missile. The accuracy of the system is improved if the anti-gravity bias signal is adjusted to reflect the direction at which the nozzle is fired. Secant means 84 provides this correction.

The threshold of the voltage to frequency converter 93 is set so that an output signal is sent to a pulse generator 85 whenever a predetermined voltage level of the input signal is detected. Output of the pulse generator 85 is the firing rate command, indicated as $F_c$ in FIG. 10.

The output of filter 81 is fed to a rate network 86. Rate network 86 is similar to rate network 82 and is not described in detail. The output of rate network 82 forms an input to the scant means 84 and also is the thrust angle command, indicated as $\phi_c$ in FIG. 10.

An acceleration switch 87 is carried by the missile 2. Acceleration switch 87 is operatively connected to a time delay circuit means 97. A power supply 89 is connected to a regulator and converter means 92 through a time delay switch 88 and to the time delay circuit means 97. Power is applied to most of the decoder 9 circuit after missile launch through the time delay switch 88. Power application after launch reduces the possibility of component electrical failure due to launch shock distortion of the internal leads. Time delay 97 receives power at missile battery activation and starts its timing function upon receipt of a missile first motion signal provided by closure of the acceleration switch 87. Time delay 97 prevents the pulse means 85 from generating firing rate command signals until such time as the missile actually is within the projected beam. After the 475 microsecond delay provided by time delay 97, the decoder circuit 9 becomes fully operational and the missile 2 will begin its self-alignment with beam center.

Operation of the guidance system of this invention is relatively simple. The missile director 6 is aimed at the target 5 and the missile 2 is launched by activation of a trigger command means 17, shown in FIG. 2. Missile activation, as indicated, initiates the zoom program control. The target is illuminated continuously during missile flight. Upon beam capture of the missile, the information contained in the beam, through the single receiver decoder assembly carried by the missile, is sufficient to enable the missile to position itself properly within the beam for flight toward the target.

It thus is apparent that the guidance system as provided meets all the ends and objects as hereinabove set forth.

Numerous variations, within the scope of the appended claims, will be apparent to those skilled in the art in light of the foregoing description and accompanying drawings. Thus, the guidance system of this invention is compatible with a number of applications, in addition to the weapon system disclosed herein. For example, the system may be used in devices for controlling the approach of an aircraft to an airfield. Even in the weapons application, other missiles, in addition to that described in the above-referenced Tucker patent, are compatible with the broader aspects of this invention. The design of the reticle may vary in other applications. While preferably both the reticle center and the reticle about its center rotate, only the reticle center need be rotated. However, systems in which mere rotation of the reticle center is used will not provide information to the decoder as accurately as the system described. Various other forms of enclosures may be used for the missile director 6, if desired. Various components or designs indicated as preferred may be changed in other designs or other applications of our invention. It will be understood that certain features and subcombinations of our invention are of utility and may be employed without reference to other features and subcombinations. With the information disclosed in the drawings and described hereinabove, those skilled in the art will be able to construct physical circuits from the block diagrams shown. If additional circuit design information is desired, it may be obtained, for example, from *Phase Lock Techniques,* Floyd M. Gardner, John Wiley and Sons, 1966; *Op Amps Replace Transformer in Phase-Detector Circuit, A. Gaugi, Electronics, May* 12, 1969; and *Characteristics and Applications of Modular Analog Multipliers,* E. Zuch, Electronic Instrumentation Digest, April, 1969. These variations are merely illustrative.

Having thus described the invention, what is claimed and desired to be secured by Letters Patent is:

1. A guidance system for directing the maneuvers of a guided device, comprising:

a single radiated beam source of producing a single radiated beam;

means for projecting said radiated beam along a first axis;

a reticle having the center of rotation positioned along a second axis, said reticle having a plurality of spokes extending outwardly from said reticle center, said reticle center being mounted for rotation about said first axis, said reticle being rotatable about said second axis, at least a portion of said reticle intersecting said beam during rotation of said reticle about said first axis and said reticle about said second axis;

means for rotating said reticle about said second axis at a first rotational speed;

means for orbitally rotating the reticle center about said first axis at a second rotational speed;

means for sequentially pulsing said single radiated beam source at a first rate during a first portion of one complete orbital revolution of said reticle center about said first axis, and for pulsing the single radiated beam source at a second rate during a second portion of one complete orbital revolution of said reticle center about said first axis;

means carried by said guided device for receiving the beam input from said radiated beam source; and decoding means for providing information contained in said beam for positioning said device, said decoding means being operatively connected to said receiving means in said guided device, the information in said beam including distance and direction representations for permitting said guided device to determine a correction course to align itself with said first axis.

2. The guidance system of claim 1 wherein said projecting means includes means for maintaining the radiated beam power at a predetermined magnitude as sensed by the guided device, and at an approximately constant level for a major portion of the distance of travel of said guided device.

3. The guidance system of claim 2 wherein said projecting means includes means for maintaining the spatial frequencies of the projected beam and the guided device displacement from the center of the beam approximately in a constant ratio range at the position of the guided device.

4. The guidance system of claim 3 wherein said projecting means which includes power density maintaining means and the spatial frequency maintaining means comprises a pair of tandem zoom lenses, and means for driving said lens pair in accordance with the predetermined effective range of said guided device so as to maintain relatively constant radiated beam power density and constant frequency versus displacement sensitivity at said guided device.

5. The guidance system of claim 4 wherein said radiated beam source is a laser diode.

6. The guidance system of claim 5 wherein said beam input receiving means is further characterized by filter means for filtering unwanted spectral frequency components in the receiving means input, and means for automatically varying the input power threshold of said receiving means as a function of the received beam power.

7. The guidance system of claim 6 wherein said decoding means comprises a device for deriving distance signals and direction signals for said guided device.

8. The guidance system of claim 7 wherein said decoding means is further characterized by means of deriving quadrature axes beam center displacement signals by product demodulation of a first signal, derived by discriminating the information spatial frequencies of the beam, and a second reference signal derived from the beam input pulse repetition rate.

9. The guidance system of claim 8 further characterized by means for providing an anti-gravity component bias signal to said missile, and means, responsive to the direction component derived in said decoding means, for maintaining an approximately constant average anti-gravity thrust force signal to said guided device.

10. A guidance system, comprising: means for generating a laser beam from a single source;

means for projecting said laser beam along a first axis;

a reticle having a center, said reticle being mounted for rotation at a position offset wth respect to said first axis and rotatable with respect to said beam so that all projected beam energy passes through said reticle;

means for orbitally rotating said reticle about said first axis;

means for pulsing said laser beam generating means at two different rates, said pulsing rate being determined by the position of said reticle;

a device capable of correcting its course to align itself with the center of said laser beam;

single receiver means mounted to said device for receiving the beam transmitted through said reticle, said receiver including means for automatically varying the input power threshold of said receiving means as a function of received beam power; and decoder means for generating course direction command signals to said device and operatively connected to said receiver means, said decoder means being carried by said device.

11. The guidance system of claim 10 further characterized by means for rotating said reticle about its center, said reticle being driven about its center at a speed different from the speed at which said reticle is orbitally rotated about said first axis.

12. The guidance system of claim 11 wherein said projecting means includes means for maintaining the power density of the radiated beam at an approximately constant level for a major portion of the distance traveled by said device.

13. The guidance system of claim 12 wherein said power density maintaining means comprises a pair of tandem zoom lenses, and means for driving said lens pair in accordance with predetermined effective range of said device so as to maintain relatively constant radiated beam power density and frequency versus displacement at said device.

14. The guidance system of claim 13 wherein said means for rotating the reticle about said first axis comprises:

a drive motor;

a gear system including a first gear driven directly by said motor, an encoder gear driven by said first gear, a second gear driven by said encoder gear, a rotor mounted for rotation with said second gear, said rotor having a central axis coincident with an axis of said generated beam, said reticle being mounted to said rotor along an axis offset from said rotor axis, said reticle being rotatable with said rotor.

15. The guidance system of claim 14 wherein said means for rotating said reticle about its center comprises an intermediate gear operatively connected to and driven by said rotor, and a reticle gear driven by said intermediate gear, said reticle being operatively connected at the center thereof to said reticle gear.

16. The guidance system of claim 15 further characterized by means for determining reticle position operatively connected to said gear system, said reticle position determining means generating a signal for controlling the output of said laser pulsing means.

17. In a guidance system for providing guidance information to a missile for directing the missile toward a target, the improvement which comprises means for projecting a binary coded beam of electromagnetic energy along an axis, said beam containing information signals enabling said missile to align itself with said axis, said projecting means including means for generating a single laser beam, means for projecting said generated beam along a predetermined line of sight, reticle means having a center, said reticle means being mounted for rotation with respect to said beam so that all beam energy transmitted from said projecting means passes through said reticle, means for rotating said reticle about its center, means for orbitally rotating said reticle, the orbital speed of rotation of said reticle being different than the speed of rotation of said reticle about its center, and means for pulsing said single laser beam generating means at a first rate for approximately half of one orbital revolution, and at a second rate for the other half of an orbital revolution of the reticle.

18. The improvement of claim 17 wherein said projecting means includes means for maintaining the power density of the radiated beam at the range of the missile at an approximately constant level for a major portion of travel of said missile.

19. The improvement of claim 18 wherein said power density maintaining means comprises a pair of tandem zoom lenses, and means for driving said zoom lens pair in accordance with the range of said missile so as to maintain a relatively constant radiated beam power density at said missile.

20. The improvement of claim 19 further characterized by means for determining the position of said reticle center operatively connected between said reticle center rotating means and said laser beam generating pulsing means, said reticle positioning determining means comprising a disc having a spaced opening in it, said disc being driven by said reticle center rotating means, a light emitting diode adapted to direct an output through the opening in said disc, and a photodiode adapted to detect the light emitting diode output as modulated by said disc.

21. In a guidance system for providing guidance information to a missile for directing the missile toward a target, including single means for generating and projecting a laser beam along a predetermined field of view, said field of view having a central axis, and means for coding said beam so as to provide both distance and direction of any point in the field of view to the central axis, the improvement which comprises:

a single receiver carried by said missile for receiving an input signal from said beam, said receiver including means for filtering unwanted spectral frequency components from said receiver input, and means for automatically carrying the input power threshold of said receiver as a function of beam power; and means for decoding the information contained in said beam input to said receiver, said decoding means being carried by said missile and being operatively connected to said receiver, said decoding means including a first information channel for deriving signals representative of the distance and unreferenced direction of said missile from said central axis, and a second reference channel for deriving a signal representing the direction reference to said central axis, said decoder having a first, rate output signal and a second, direction output signal.

22. The structure of claim 21 further characterized by means of providing an anti-gravity bias component signal to said missile, said anti-gravity biasing signal means being carried by said missile, and means, carried by said missile, responsive to the second, direction output signal of said decoder for modifying the level of said gravity bias signal.

23. A method for providing information in a laser beam for guiding a missile, comprising:

generating a laser beam from a single laser source;

projecting said laser beam through space along a first axis;

rotating orbitally a reticle about said first axis so that said reticle intersects said beam, with the reticle center being positioned along a second axis offset from said first axis; and pulsing said single laser source at a first frequency for at least one portion of each revolution of said reticle center and at a second frequency for at least a second portion of each revolution of said reticle center, the sum of said portions of each revolution being equal to the total revolution.

24. The method of claim 23 including the further step of rotating said reticle about its center, the speed or rotation of said reticle about its center being different from the speed of orbital rotation of the reticle about said first axis.

25. The method of claim 24 including the further step of receiving said generated beam at a receiver at the missile, including varying the input power threshold of said receiver as a function of the received beam power.

26. A guidance system for directing the maneuvers of a guided device, comprising:

a single radiated beam source for providing a single radiated beam;

means for projecting said radiated beam along a first axis;

a reticle positioned with the center thereof along a second axis, said reticle having a plurality of spokes of alternately opaque and transparent characteristics extending outwardly from said center, said reticle center portion being mounted for orbital rotation about said first axis, said reticle being rotatable about said second axis, at least a portion of said reticle intersecting said beam during rotation of the center thereof about said first axis and said reticle about said second axis;

means for rotating said reticle about said second axis;

means for orbitally rotating said reticle about said first axis, the rotations about said first and second axes being dependent upon one another;

means for sequentially pulsing said single radiated beam source at a first rate during a first portion of one complete orbital revolution of said reticle center about said first axis, and for pulsing said single radiated beam source at a second rate during a second portion of one complete orbital revolution of said reticle about said first axis;

means carried by said guided device for receiving the beam input from said radiated beam source; and means for decoding signal information contained in said beam for positioning said device, said decoding means being operatively connected to said receiving means in said guided device, the signal information in said beam including distance and direction representations for permitting said guided device to determine a correction course to align itself with said first axis.

* * * * *

UNITED STATES PATENT AND TRADEMARK OFFICE

CERTIFICATE OF CORRECTION

PATENT NO. : 4,014,482

DATED : March 29, 1977

INVENTOR(S) : Andrew T. Esker, John L. Manche, Robert M. Siler

It is certified that error appears in the above-identified patent and that said Letters Patent are hereby corrected as shown below:

Col. 7, line 18, "180° or" should be "180° of".

Col. 13, line 38, "scant means 84" should be "secant means 84".

Col. 14, line 46, "source of producing" should be "source for producing".

Col. 15, line 47, "means of" should be "means for".

Col. 15, line 56, "direction component derived" should be "direction component signal derived".

Col. 15, line 65, "wth" should be "with".

Col. 18, line 8, "rotating orbitally" should be "orbitally rotating"

Col. 18, line 19, "speed or" should be "speed of".

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*